US011029100B2

(12) United States Patent
Siegel et al.

(10) Patent No.: US 11,029,100 B2
(45) Date of Patent: Jun. 8, 2021

(54) HEAT EXCHANGER

(71) Applicant: Mahle International GmbH, Stuttgart (DE)

(72) Inventors: Albrecht Siegel, Ludwigsburg (DE); Simon Hund, Stuttgart (DE); Faber Christian, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/307,366

(22) PCT Filed: Apr. 28, 2015

(86) PCT No.: PCT/EP2015/059209
§ 371 (c)(1),
(2) Date: Oct. 27, 2016

(87) PCT Pub. No.: WO2015/165903
PCT Pub. Date: Nov. 5, 2015

(65) Prior Publication Data

US 2017/0045308 A1 Feb. 16, 2017

(30) Foreign Application Priority Data

Apr. 29, 2014 (DE) ..... 10 2014 208 093.2

(51) Int. Cl.
*F28F 9/00* (2006.01)
*F02M 26/32* (2016.01)
(Continued)

(52) U.S. Cl.
CPC ..... *F28F 9/002* (2013.01); *F02M 26/32* (2016.02); *F28D 7/103* (2013.01); *F28D 7/16* (2013.01);
(Continued)

(58) Field of Classification Search
CPC ..... F28F 1/00; F28F 9/00; F28F 9/001; F28F 9/002; F28F 9/005; F28F 9/007;
(Continued)

(56) References Cited

U.S. PATENT DOCUMENTS 1,657,028 A 1/1928 Nelson
1,963,442 A * 6/1934 McNaughton ..... F24D 1/005 165/101
(Continued)

FOREIGN PATENT DOCUMENTS

DE 7930351 U1 3/1980
DE 102010025031 A1 12/2011
(Continued)

OTHER PUBLICATIONS www.thermopedia.com "Shell and tube Heat Exchangers, Mechanical Design" Brogan, R.J. Feb. 2011.*
(Continued)

*Primary Examiner* — Len Tran
*Assistant Examiner* — Gustavo A Hincapie Serna
(74) *Attorney, Agent, or Firm* — Fishman Stewart PLLC

(57) ABSTRACT

A heat exchanger for an internal combustion engine may include a base tube and a flange extending at least partially around the base tube. The flange may be formed as a forged piece.

15 Claims, 1 Drawing Sheet

(51) Int. Cl.
*F28D 7/16* (2006.01)
*F28D 7/10* (2006.01)

(52) U.S. Cl.
CPC ..... *F28F 2275/00* (2013.01); *F28F 2275/025* (2013.01); *F28F 2275/04* (2013.01); *F28F 2275/06* (2013.01); *F28F 2275/10* (2013.01)

(58) Field of Classification Search
CPC .. F28F 9/013; F28F 2275/025; F28F 2275/04; F28F 2275/06; F28F 2275/10; F28D 7/00; F28D 7/10; F28D 7/103; F28D 21/003; F28D 1/06; F02M 26/32; F01N 2240/02
USPC ..... 165/104.14, 154, 157, 158, 73, 74, 75
See application file for complete search history.

(56) References Cited

U.S. PATENT DOCUMENTS 2,207,036 A * 7/1940 Jacocks ..... F22D 1/006 165/76
3,441,381 A * 4/1969 Keith et al. ..... B01D 53/944 422/119
3,854,888 A * 12/1974 Frietzsche ..... F01N 3/2853 29/463
3,937,276 A * 2/1976 Ostwald ..... F28D 7/1638 165/132
4,248,833 A * 2/1981 Aoyama ..... F01N 3/2867 422/179
4,452,063 A * 6/1984 Sebastiani ..... B21D 41/02 29/890.15
4,630,673 A 12/1986 Belleli
4,662,435 A * 5/1987 Bohlin ..... F01P 11/00 165/119
6,626,235 B1 * 9/2003 Christie ..... F28D 7/106 165/158
7,258,842 B2 * 8/2007 Bruck ..... F01N 3/2839 422/171
7,461,506 B2 * 12/2008 McNally ..... F01N 3/02 138/112
7,503,956 B2 * 3/2009 Thaler ..... B01D 46/10 55/523
7,543,471 B2 * 6/2009 Birkert ..... B21D 17/025 165/160
7,662,204 B2 * 2/2010 Forster ..... F01N 13/185 55/523
7,779,624 B2 * 8/2010 Belisle ..... F01N 13/009 60/299
7,857,898 B2 * 12/2010 Wiggins ..... F23G 7/085 96/242
8,988,881 B2 * 3/2015 Koplow ..... F28D 15/0275 361/707
2005/0205825 A1 * 9/2005 Anschicks ..... F16K 27/0218 251/305
2006/0067860 A1 * 3/2006 Faircloth, Jr. ..... F16L 59/184 422/171
2006/0108108 A1 * 5/2006 Naukkarinen ..... F28F 9/262 165/163
2011/0209857 A1 * 9/2011 Naukkarinen ..... F28D 7/02 165/164
2012/0186780 A1 * 7/2012 Ilgner ..... F02B 29/045 165/76
2014/0000848 A1 * 1/2014 Siegel ..... F28F 1/00 165/104.14
2015/0328726 A1 11/2015 Siegel et al.

FOREIGN PATENT DOCUMENTS

DE 102011081031 A1 * 2/2013 ..... F28D 7/1684
DE 102012211311 A1 1/2014
EP 2559962 A2 * 2/2013 ..... F28F 9/005

OTHER PUBLICATIONS www.thermopedia.com "Heat and Shell Heat Exchangers" (Year: 2011).*
Machine Translation EP 2559962 A2 (Year: 2012).*
Thermopedia—Shell and Tube Heat Exchangers (Year: 2011).*
www.thermopedia.com (Year: 2011).*
Edwards—Design and Rating Shell and Tube Heat Exchangers (Year: 2008).*
German Search Report for DE-102014208093.2, dated Nov. 10, 2014.

* cited by examiner

HEAT EXCHANGER

CROSS-REFERENCE TO RELATED APPLICATIONS

This application claims priority to German Patent Application No. DE 10 2014 208 093.2, filed on Apr. 29, 2014, and International Patent Application No. PCT/EP2015/059209, filed on Apr. 28, 2015, both of which are hereby incorporated by reference in their entireties.

TECHNICAL FIELD

The present invention relates to a heat exchanger for an internal combustion engine, having a base tube and a flange extending at least partially around the base tube. The invention also relates to a motor vehicle equipped with such a heat exchanger.

BACKGROUND

DE 2012 211 311 A1 discloses a generic heat exchanger for an internal combustion engine, having a base tube in which there are arranged tubes carrying a first fluid, which are held at the ends in tube sheets, and having a flange extending at least partially around the base tube. Here, the tubes extending in the base tube form a first flow channel, for example for exhaust gas, whereas a second flow channel, for example for coolant, is formed between the tubes and the base tube. In at least one of its end regions, the heat exchanger has a first flange running at least partially around the base tube and formed in one piece with the heat exchanger. As a result of the one-piece construction of the flange with the base tube of the heat exchanger, in particular an additional mounting step is to be able to be omitted.

DE 10 2010 025 031 A1 discloses a heat exchanger for an internal combustion engine, likewise having a base tube with a circumferential ring and tube sheets at the ends, wherein the tube sheets are connected to the base tube. An end cap is respectively arranged in the region of the tube sheets, one of which has a beaded portion running around and directed outward, around which a detachable clamping element can grip and which is connected to the ring. Furthermore, a circumferential sealing element is arranged between the beaded portion and the ring. Here, the ring is made of sheet metal and, in its cross section, has limbs directed toward one another in a V shape, which are connected to the base tube of the heat exchanger via a web.

Heat exchangers are used, for example, for heat recovery or the cooling of the proportion of exhaust gas from an internal combustion engine that is intended to be recirculated. By means of the recirculation to the combustion air, in particular when leaner mixtures are used in combination with high combustion temperatures, the proportion of environmentally damaging nitrogen oxides in the exhaust gas is reduced. Usually, such a heat exchanger provides a base tube which is connected to a tube sheet in each case at the ends. The tubes carrying the exhaust gas are collected together to form a tube bundle within the base tube and extend between opposite tube sheets or are held by the latter. The base tube connected to the tube sheets thus forms a chamber through which cooling fluid can flow and the exhaust gas passes over the tube bundle.

In order to be able to attach the heat exchanger and in particular the exhaust gas heat exchanger to elements connected upstream or downstream, a flange is usually provided, which is produced directly on the relevant components by the use of injection molding or pressure die-casting methods or, if the use of such methods is not possible, is fitted thereto by a mounting. Here, the flange is usually formed as a cast part.

The disadvantage with the prior art is in particular that the flange represents an additional component, as a result of which parts costs arise and which not only has to be additionally connected to the base tube of the heat exchanger but previously has to be reworked mechanically in a complicated manner. It proves to be a further disadvantage that such a flange formed as a cast part is comparatively heavy, which increases the fuel consumption, in particular when used in a motor vehicle, and causes high material costs.

SUMMARY

The present invention therefore deals with the problem of specifying an improved embodiment for a heat exchanger of the generic type, which in particular overcomes the disadvantages known from the prior art.

According to the invention, this problem is solved by the subject matter of the independent claims. Advantageous embodiments are the subject matter of the dependent claims.

The present invention is based on the general idea, in a heat exchanger known per se for an internal combustion engine, of forming a flange extending at least partially around a base tube of the heat exchanger as a forged piece for the first time, in particular even as a comparatively thin forged piece, as a result of which, as compared with a cast part, not only can a weight advantage be realized but, in addition, complicated and therefore expensive mechanical re-working can be dispensed with. Forged pieces of this type can thus be produced economically, with weight optimization and nevertheless with high quality. The heat exchanger is preferably formed as an exhaust gas heat exchanger, the flange serving for the attachment of further components.

In an advantageous development of the solution according to the invention, the flange is welded, brazed, pressed or adhesively bonded to the base tube. Since, in a heat exchanger formed as an exhaust gas heat exchanger, the comparatively hot exhaust gas is carried in a tube bundle extending in the base tube, only cooling medium flows through a chamber formed by the base tube and the tube bundle, so that attachment of the flange resting on the outside of the base tube by means of adhesive bonding is theoretically possible. Likewise possible is brazing or welding or else pressing, wherein this presupposes that the flange is formed as a ring and extends completely around the base tube of the heat exchanger.

In a further advantageous embodiment of the solution according to the invention, the flange has a V-shaped cross section and/or has at least one contact section with which it rests flatly on the base tube. As a result of forming the flange with a V-shaped cross section, a fixing contour is created over which, for example, a clamping ring can be drawn. Here, the component further to be fixed to the heat exchanger is clamped in between the clamping ring and the flange. As a result of the at least one contact section, a greater contact area between the flange and the heat exchanger is provided, which is advantageous in particular during gap brazing. In the case of adhesive bonding of the flange to the base tube, a greater adhesive area can also be provided as a result.

Expediently, the flange has a thread. Such a thread, which means an external thread, can be produced simultaneously during the forging operation, so that the thread itself also preferably requires no complicated mechanical re-working.

Of course, it is also conceivable for the thread to be cut into the flange after the actual forging operation. Via such a thread, the other component to be connected to the heat exchanger can simply be screwed on, provided it has a thread formed to be complementary thereto.

Further important features and advantages of the invention can be gathered from the sub-claims, from the drawings and from the associated figure description using the drawings.

It goes without saying that the features mentioned above and those still to be explained below can be used not only in the respectively specified combination but also in other combinations or on their own without departing from the scope of the present invention.

Preferred exemplary embodiments of the invention are illustrated in the drawings and will be explained in more detail in the following description, wherein the same designations relate to identical or similar or functionally identical components.

BRIEF DESCRIPTION OF THE DRAWINGS

In the figures, in each case schematically.

DETAILED DESCRIPTION

Figure 1:
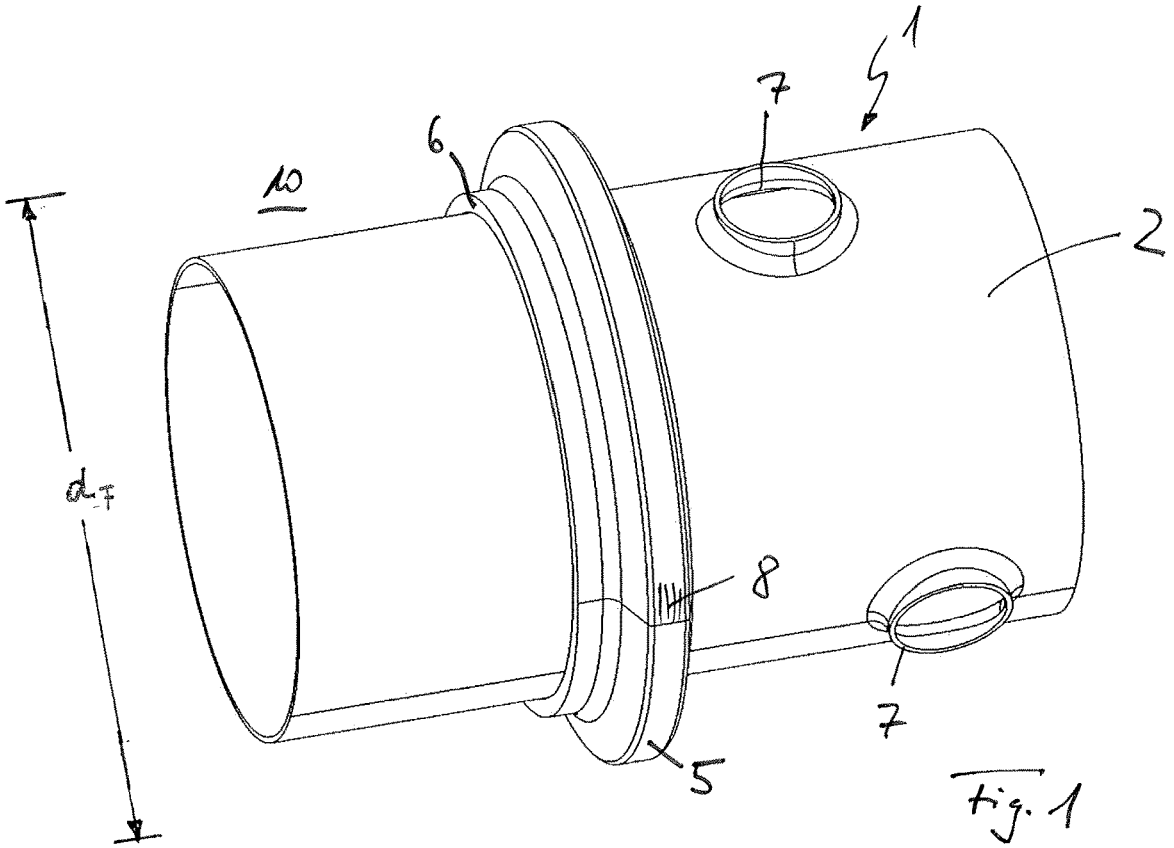
FIG. 1 shows a view of a heat exchanger according to the invention.
Figure 2:
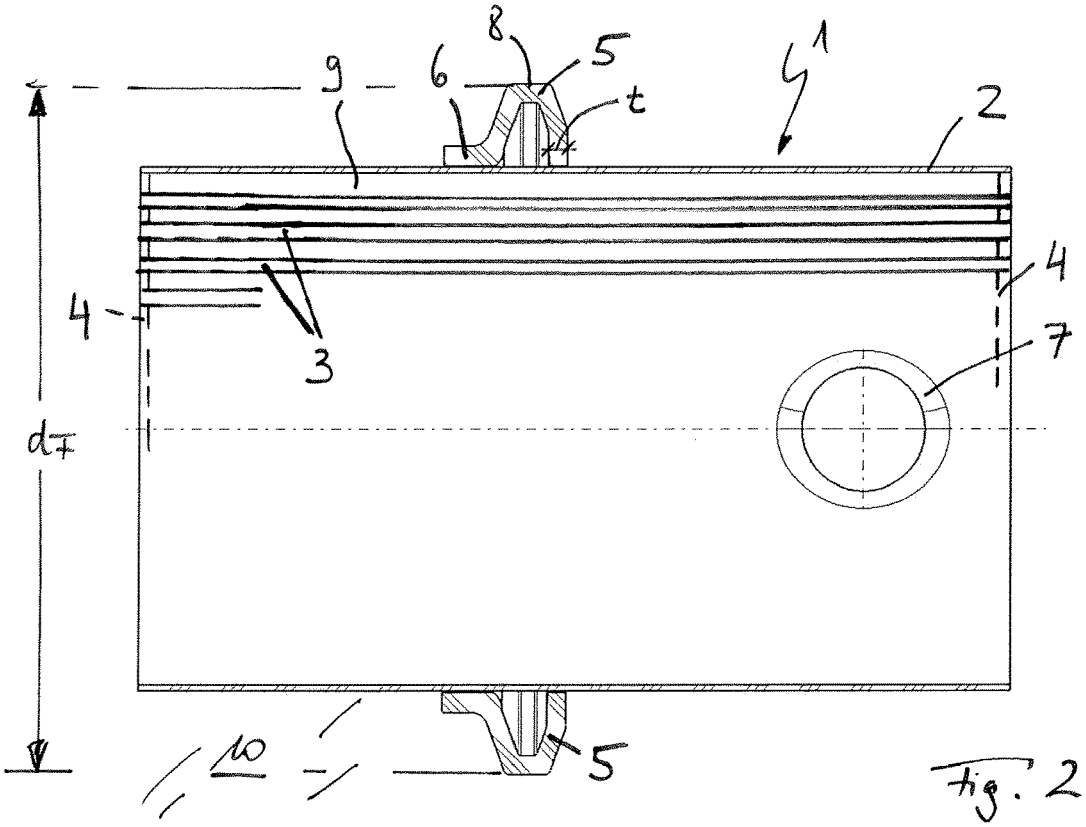
FIG. 2 shows a sectional illustration through the heat exchanger according to the invention.

According to FIGS. 1 and 2, a heat exchanger 1 according to the invention, which can be formed as an exhaust gas heat exchanger, for example, has a base tube 2, in which tubes 3 carrying a first fluid (cf. FIG. 2) are arranged in the manner of a tube bundle. This tube bundle is held at the ends in opposite tube sheets 4. According to FIG. 2, here the tubes 3 and the tube sheets 4 are sketched only partly. Extending at least partially around the base tube 2, here even running completely around, there is arranged a flange 5 which, according to the invention, is formed as a forged piece. Forming the flange 5 as a forged piece offers the great advantage that complicated mechanical re-working, as was necessary in the previous formation of the flange 5 as a cast part, is now no longer necessary. Furthermore, such a flange 5 formed as a forged piece is considerably lighter than a flange formed as a cast part, which means that weight advantages can be realized which bring advantages with regard to fuel consumption and exhaust gas emission, in particular when the heat exchanger 1 according to the invention is used in a motor vehicle.

If FIG. 2 in particular is considered, it can be seen that the flange 5 has a V-shaped cross section and in addition has a contact section 6, with which it rests flatly on the base tube 2. Via this contact section or in general, the flange 5 can be welded, brazed, pressed or adhesively bonded to the base tube 2.

In addition, the base tube 2 has two connecting pieces 7 via which a second fluid can be led into the interspace 9 remaining between the tubes 3 and the base tube 2.

Of course, it is also conceivable for the flange 5 to have a thread 8, via which, for example, a further component can be screwed to the flange 5. The thread 8 can likewise be forged or else subsequently turned into the flange 5.

Advantageously, a wall thickness t of the flange 5 lies between 2 mm≤t≤3.0 mm, in particular at t=2.3 mm. In particular in the case of a flange 5 with a flange diameter $d_F$ of 112 mm, the aforesaid wall thicknesses t are particularly advantageous. In this way, the flange 5 can be formed with a considerably lower wall thickness than would be possible in the case of a flange made of cast material. The weight can also be reduced as a result of the lower wall thickness t.

Above all, however, no mechanical re-working is required, which means that costs can likewise be spared. As a result of a lack of contaminants (slag, inclusions), as always have to be tolerated in the case of cast components, and as a result of a more homogenous distribution of the alloy components, improved mechanical characteristics can be achieved in forged flanges 5. As a result of the microstructure being more homogenous as compared with cast components (small-grained in forged components and coarse-grained in cast components), forged pieces also exhibit improved corrosion characteristics and increased fatigue strength. In addition, in the case of flanges 5 formed as forged pieces, the fatigue characteristics can be influenced advantageously, since the grains in the structure of the flange 5 are aligned after the forging. In the case of cast components, on the other hand, the grain growth following solidification is preferentially oriented in the transverse direction, since the solidification begins at the surface and continues inward as a result of the growth of coarse column-like grains, which is particularly disadvantageous from fatigue points of view.

As a result of the implementation of the flange 5 as a forged piece, the mechanical machining which is required in the case of a flange formed as a cast part can be dispensed with and, as a result, costs can be saved. Furthermore, thinner wall thicknesses can be realized. Moreover, as a result of the reduced use of material, weight and costs can be saved.

The invention claimed is:

1. A heat exchanger for an internal combustion engine, comprising:

a base tube;

a flange extending at least partially around the base tube, wherein the flange is formed as a forged piece; and an adhesive between the flange and the base tube to provide a permanent bond between the flange and the base tube;

wherein the flange has a V-shaped cross-section and is formed by a wall bent in the shape of a V to form the V-shaped cross-section with a cavity between the wall and the base tube;

wherein the flange has a thread on a radially outermost section of the flange; and wherein a wall thickness t of the flange is in the range of 2 mm≤t≤3.0 mm, and a ratio of an outer diameter of the flange to the wall thickness ranges between 37.3:1 and 56:1.

2. The heat exchanger as claimed in claim 1, wherein the heat exchanger is formed as an exhaust gas heat exchanger.

3. The heat exchanger as claimed in claim 1, wherein the flange is formed as a closed ring.

4. The heat exchanger as claimed in claim 1, wherein the flange has at least one contact section with which the flange rests flatly on the base tube.

5. The heat exchanger as claimed in claim 1, wherein the base tube has two connecting pieces via which a fluid is led into an interspace delimited by tubes of the base tube and the base tube.

6. The heat exchanger as claimed in claim 1, wherein a wall thickness t of the flange is 2.3 mm.

7. A motor vehicle comprising at least one heat exchanger having:

a base tube;

a flange extending at least partially around the base tube, wherein the flange is formed as a forged piece; and an adhesive between the flange and the base tube to provide a permanent bond between the flange and the base tube;

wherein the flange is formed by a wall having a contact section and a V-shaped section, the contact section resting flatly against the base tube, and the contact section and the V-shaped section having a same thickness;

wherein the V-shaped section has a thread; and wherein a wall thickness t of the flange is in the range of 2 mm≤t≤3.0 mm, and a ratio of an outer diameter of the flange to the wall thickness ranges between 37.3:1 and 56:1.

8. The heat exchanger as claimed in claim 2, wherein the flange is formed as a closed ring.

9. The heat exchanger as claimed in claim 2, wherein the flange has a thread.

10. The heat exchanger as claimed in claim 2, wherein a wall thickness t of the flange is in the range of 2 mm≤t≤3.0 mm.

11. The heat exchanger as claimed in claim 10, wherein the flange is formed as a closed ring.

12. The heat exchanger as claimed in claim 10, wherein the flange has a thread.

13. A heat exchanger for an internal combustion engine, comprising:

a base tube having tubes in which a first fluid is flowable, and two connecting pieces via which a second fluid is led into an interspace delimited by the tubes and the base tube; and a flange extending at least partially around the base tube, the flange being formed from a wall bent to have at least one contact section with which the flange rests flatly on the base tube, and a V-shaped section defining a cavity between the wall and the base tube, the flange being formed as a forged piece and adhesively bonded to the base tube;

wherein the at least one contact section and the V-shaped section have a same thickness;

wherein the flange has a thread on a radially outermost section of the V-shaped section; and wherein a wall thickness t of the flange is in the range of 2 mm≤t≤3.0 mm, and a ratio of an outer diameter of the flange to the wall thickness ranges between 37.3:1 and 56:1.

14. The heat exchanger as claimed in claim 1, wherein the wall has a uniform thickness.

15. The heat exchanger as claimed in claim 5, wherein the two connecting pieces are on the same side of the flange.

* * * * *